US006209997B1

(12) United States Patent
Duong et al.

(10) Patent No.: US 6,209,997 B1
(45) **Date of Patent: *Apr. 3, 2001**

(54) IMPULSE FLUID JET APPARATUS WITH DEPRIMING PROTECTION

(75) Inventors: Ha Van Duong, Torrington; Cliff John Cahill, Sharon; Bopta Ky, Danbury, all of CT (US)

(73) Assignee: Illinois Tool Works Inc., Glenview, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/954,523

(22) Filed: Oct. 20, 1997

Related U.S. Application Data

(63) Continuation-in-part of application No. 08/828,758, filed on Mar. 25, 1997.

(51) Int. Cl.[7] ..... B41J 2/17; B41J 2/175
(52) U.S. Cl. ..... 347/94; 347/85; 347/84
(58) Field of Search ..... 347/85, 94, 84, 347/93

(56) References Cited

U.S. PATENT DOCUMENTS

| | | | | |
|---|---|---|---|---|
| 4,263,602 | * | 4/1981 | Matsumoto et al. | 347/89 |
| 4,347,524 | * | 8/1982 | Engel et al. | 347/94 |
| 4,388,630 | * | 6/1983 | Osaki et al. | 347/85 |
| 4,459,601 | | 7/1984 | Howkins | 347/68 |
| 4,509,059 | | 4/1985 | Howkins | 347/10 |
| 4,514,742 | * | 4/1985 | Suga et al. | 347/94 |
| 4,523,200 | | 6/1985 | Howkins | 347/11 |
| 4,523,201 | | 6/1985 | Liker | 347/11 |
| 4,646,106 | | 2/1987 | Howkins | 347/9 |
| 4,697,193 | | 9/1987 | Howkins | 347/9 |
| 4,777,497 | * | 10/1988 | Nozu et al. | 34/94 |
| 5,650,811 | * | 7/1997 | Seccombe et al. | 347/451 |

* cited by examiner

*Primary Examiner*—John Barlow
*Assistant Examiner*—An H. Do
(74) *Attorney, Agent, or Firm*—Lisa M. Soltis; Mark W. Croll; John P. O'Brien

(57) ABSTRACT

An impulse ink jet print head including a compliant chamber and a check valve coupled between an ink supply and an ink chamber. The compliant chamber attenuates pressure disturbances of short duration. The check valve prevents the reverse flow of ink and depriming of the print head.

10 Claims, 7 Drawing Sheets

IMPULSE FLUID JET APPARATUS WITH DEPRIMING PROTECTION

CROSS REFERENCE TO RELATED APPLICATION

This application is a continuation-in-part and claims the benefit of the filing date of U.S. patent application Ser. No. 08/828,758, filed Mar. 25, 1997.

FIELD OF THE INVENTION

This invention relates to a drop-on-demand or impulse fluid jets which eject a droplet of fluid such as ink in response to the energization of a transducer.

BACKGROUND OF THE INVENTION

Impulse fluid or ink jets are designed and driven so as to eject a droplet of fluid such as ink on demand from a chamber through an orifice in the chamber. Where impulse jets are utilized in many applications including industrial applications, it is important that the impulse ink jets operate reliably. Such reliability can be jeopardized where the impulse jets can be deprimed due to fluid disturbances in the supply of ink to and through the impulse jet. Such depriming can occur as a result of brief disturbances to the fluid supply as well large, longer disturbances caused by, for example, bumping the apparatus.

SUMMARY OF THE INVENTION

In accordance with this invention, an apparatus is provided for preventing depriming of an impulse jet.

In still further accordance with the invention, an apparatus is provided for preventing depriming of an impulse jet in response to small and/or brief disturbances in the ink or fluid supply line to the impulse ink jet or elsewhere.

In still further accordance with the invention, an apparatus is provided for preventing depriming of an impulse jet in response to large and/or longer disturbances in fluid supply line or elsewhere.

In accordance with a preferred embodiment of the invention, an impulse ink fluid apparatus comprises a transducer, and a fluid jet chamber coupled to the transducer, the chamber having an orifice through which droplets of fluid are ejected in response to the energization of the transducer. A fluid supply is coupled to the fluid jet chamber through a compliant chamber which forms at least part of a low pass filter substantially attenuating fluid disturbances having a duration substantially less than time constant of the low pass filter formed by the compliant chamber.

In the preferred embodiment, the time constant represented by the product of the fluidic capacitance of the compliant chamber and at least a portion of the fluidic resistance of the fluid supply substantially attenuates pressure disturbances having a duration less than 0.01 the value of the time constant. In the preferred embodiment, disturbances of less than 0.01 and preferably less than 0.05 seconds will be attenuated.

In the preferred embodiment, the compliant chamber comprises a compliant member for absorbing pressure waves. The compliant chamber comprises a flexible diaphragm which is nonplanar in the undisturbed state such that deformation is nonlinear with respect to changes in pressure. Preferably, pressure waves are absorbed without pressure increases in the compliant chamber. In the preferred embodiment, the compliant chamber comprises an air passage allowing ambient air pressure to flow through and reach the compliant member.

The compliant chamber may also include a filter permitting the flow of ink through the filter from the ink supply to the fluid jet chamber.

In one preferred embodiment, the apparatus further comprises at least one check valve located between the fluid jet or a manifold serving a plurality of fluid jets and the compliant chamber for preventing the reverse flow of ink from the ink jet chambers to the compliant chamber while permitting ink to flow from the compliant chamber to the ink jets. Each check valve includes passageways permitting the passage of air through the check valves. In this regard, the check valve comprises a valve seat, a valve member, a valve support comprising at least one passage permitting fluid flow between the valve seat and the valve member and through the fluid passage toward the fluid chamber. The check valve includes a valve body forming the valve seat and containing the valve member and the valve support such that the fluid passage in the valve support is located adjacent to the valve body. Preferably, the valve support comprises a plurality of passages located adjacent to the valve body.

In another preferred embodiment, the check valve, which acts as a rectifier to maintain positive pressure at the orifice(s), is coupled between the fluid supply and the compliant chamber. Moreover, in this embodiment the compliant chamber holds negative pressure between −0.1 and −10 in-$H_2O$ created by orifice jetting and the static height of the ink supply. Further, the check valve is characterized by a cracking pressure of between 0.1 and 3 in-$H_2O$, whereby excessive buildup of negative pressure at the orifice during jetting is prevented.

DETAILED DESCRIPTION OF PREFERRED EMBODIMENTS

Figure 1:
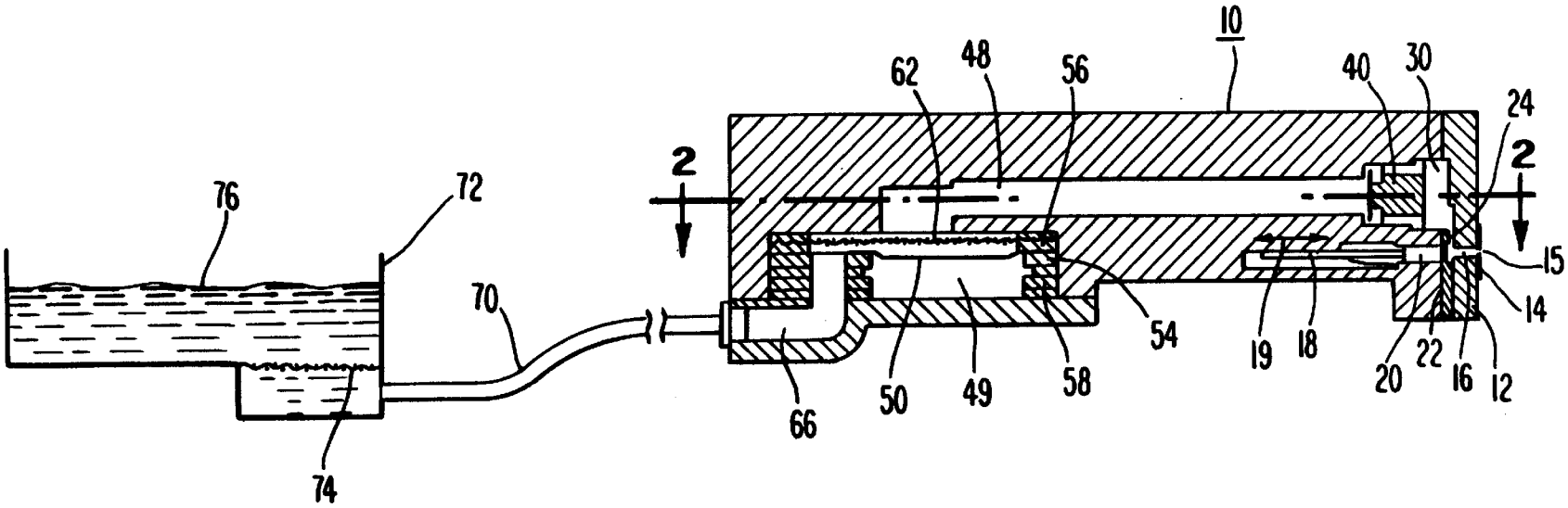
FIG. 1 depicts an impulse ink jet head incorporating the invention shown in cross-sectional form with the ink supply with the compliant chamber rotated 90° for purposes of clarity.
Figure 5:
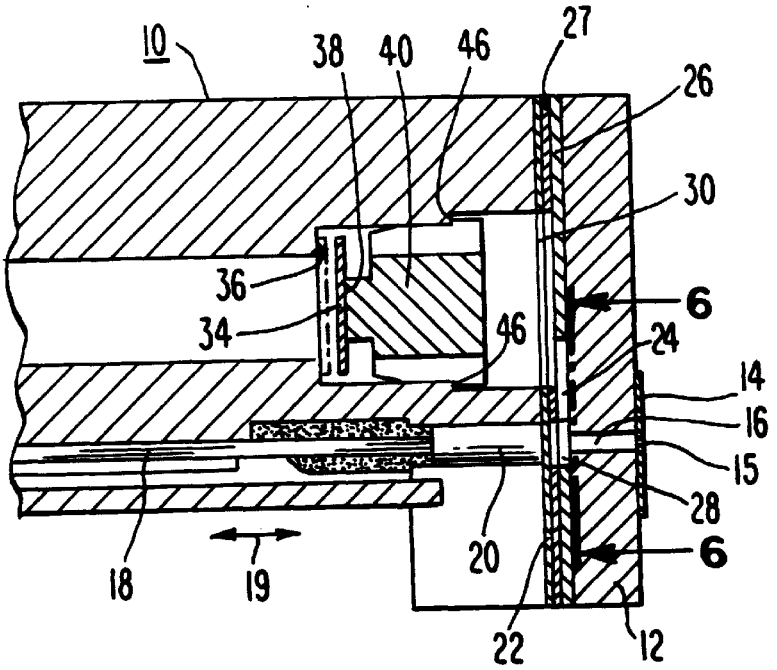
FIG. 5 is an enlarged sectional view of the check valve and the ink jet chamber shown in FIG. 1.

Referring to FIG. 1, an impulse fluid or ink jet print head 10 comprises a chamber plate 12 and an orifice plate 14 forming a plurality of ink jet chambers 16 coupled to a transducer 18 through a foot 20 and a diaphragm 22 shown in enlarged form in FIG. 5. The transducer 18 is energized and de-energized by applying a voltage transverse to the longitudinal axis of the transducer 18 so as to operate the transducer in an expander mode, i.e., the transducer expands and contracts along the longitudinal axis parallel to arrows 19 to cause volumetric changes in the chamber 16 to jet droplets from orifices 15 in the plate 14.

Figure 6:
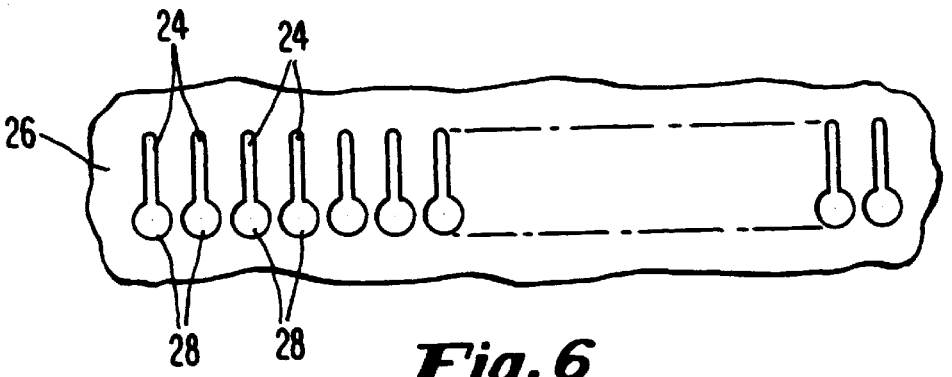
FIG. 6 is a sectional view taken along line 6—6 of FIG. 5 depicting the restrictor plate forming a portion of a plurality of ink jets in the head.

Referring to FIGS. 1 and 5, fluid in the form of ink is supplied to each chamber 16 through restricted inlets 24 formed in a restrictor plate 26 between the chamber plate 12 and a spacer plate 27 which is sandwiched up against the diaphragm 22 best shown in FIG. 5. Such restricted inlets 24 are shown in FIG. 6 which depicts the restrictor plate 26 having enlarged openings 28 as explained in co-pending application Ser. No. 08/823,718, filed Mar., 25, 1997, titled "High Performance Impulse Ink Jet Method and Apparatus", which is incorporated herein by reference. The foregoing structure including the size of the chambers 16 in conjunction with the resonant frequency of the transducers 18 produce a high performance ink jet.

Figure 2:
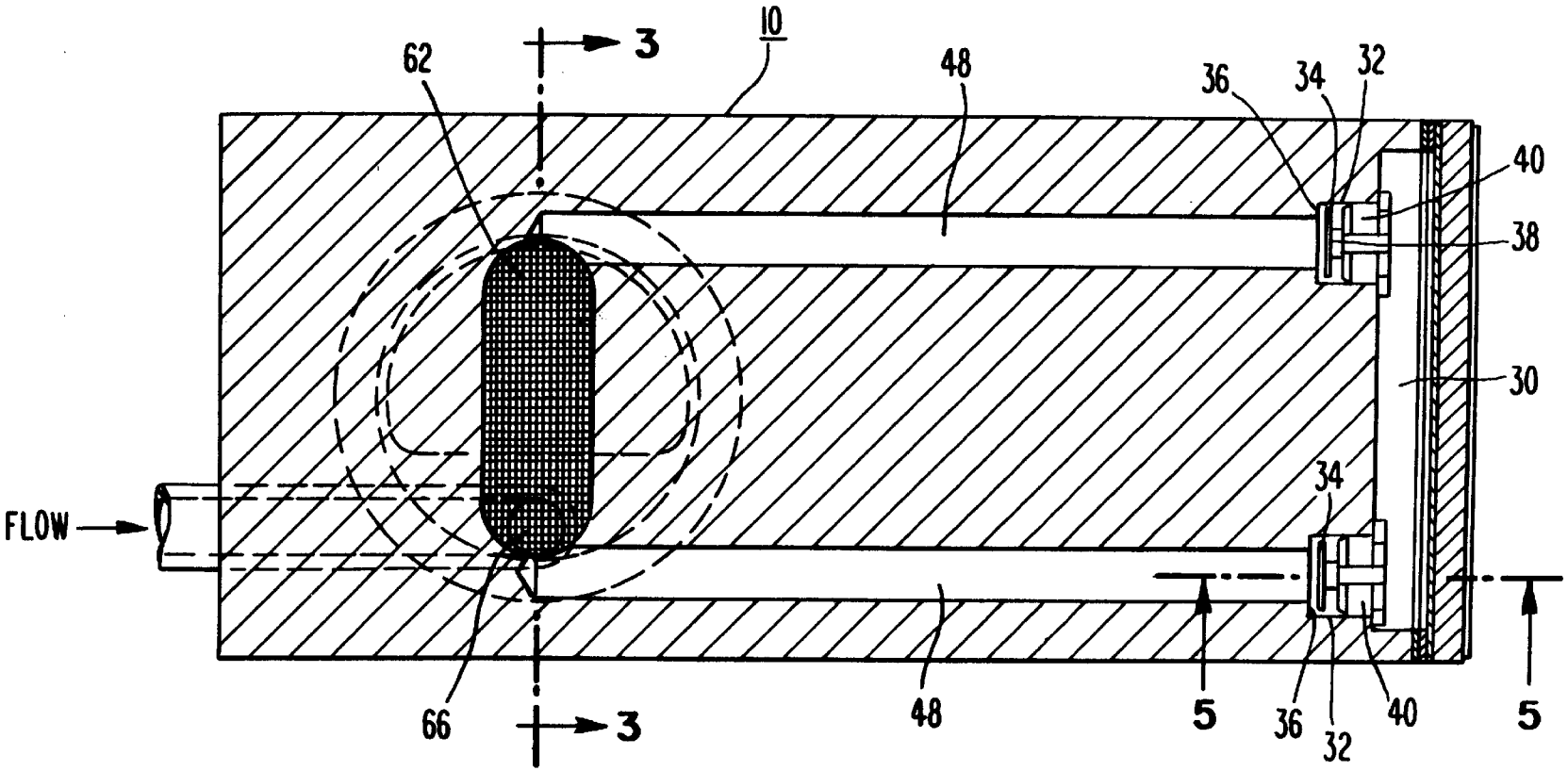
FIG. 2 is a view of the impulse ink jet head taken along section line 2—2 of FIG. 1.
Figure 7:
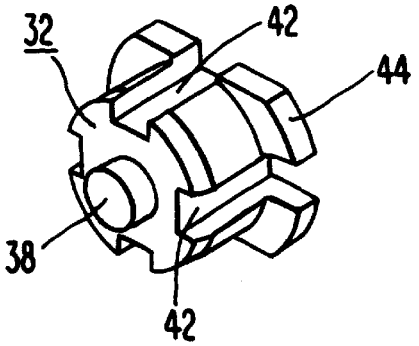
FIG. 7 is a perspective view of a check valve support member shown in FIG. 5.

Each of the restricted inlets 24 is supplied by a manifold 30 shown in FIGS. 1 and 5 as well as FIG. 2. In accordance with one important aspect of the invention, the manifold 30 is supplied with fluid in the form of ink through two check valves 32 as shown in FIGS. 1, 2 and 5. The check valves 32 are designed in a manner so as to prevent the reverse flow of ink from the 24 back through the fluid supply lines in the print head 10. Any check valve design which will prevent reverse flow from chamber 24 can be employed in the present invention. No particular design is preferred, however, for the purposes of illustrating the operation of the invention, the embodiment shown in FIG. 5 is described in detail herein. The check valves 32 shown in FIGS. 1, 2 and 5 comprise a flotable valve plate 34 movable by ink flow so as to be seated against a valve seat 36 in the print head 10 when the valve is closed due to back pressure from the fluid in manifold 30 as shown in dotted lines in FIG. 5. The valve plate 34 when open permits the flow of ink into the chamber 16 as shown in FIG. 5. As the supply of ink in manifold 30 is depleted the pressure in the manifold drops so that the ink within supply channel 48 forces valve plate 34 against end 38. Ink then fills manifold 30 and is ejected from the orifice 15 as was described above. Details of the support 40 can be best appreciated by reference to FIG. 7 wherein flow channels 42 leading away from the end 38 and toward the manifold 30 are provided and a flange 44 through which the channels 42 pass is also provided for engaging a seat 46 in the print head in the valve body for the diaphragm 34 as best shown in FIG. 5.

Figure 3:
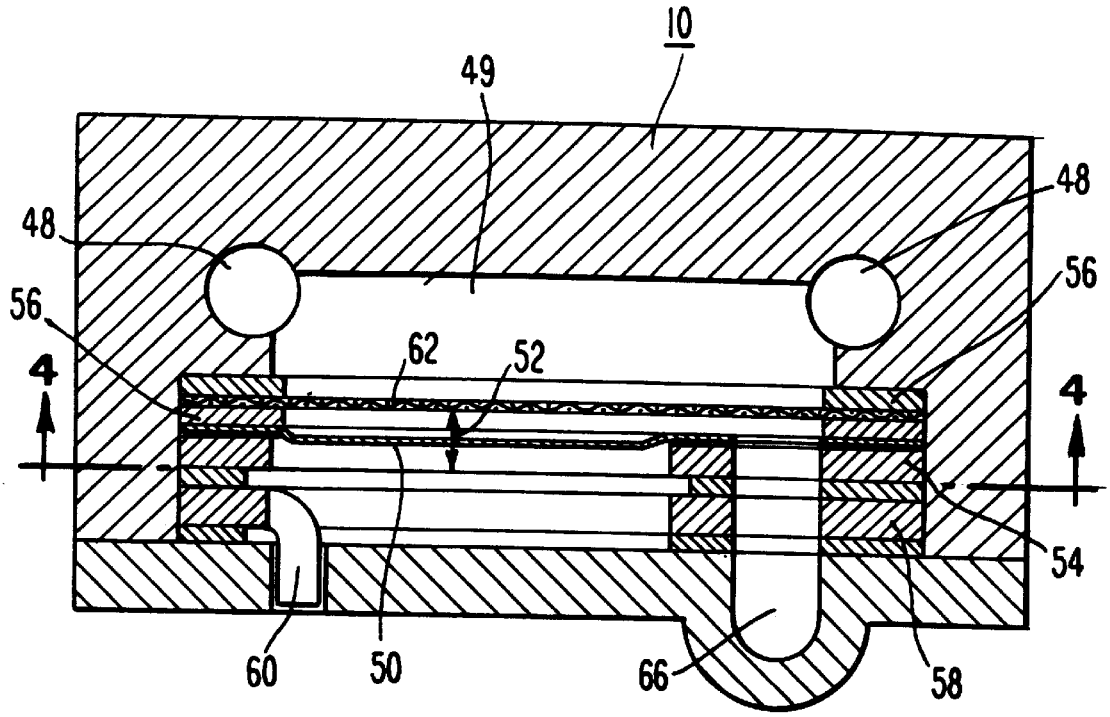
FIG. 3 is a sectional view of the compliant chamber taken along line 3—3 of FIG. 2.
Figure 4:
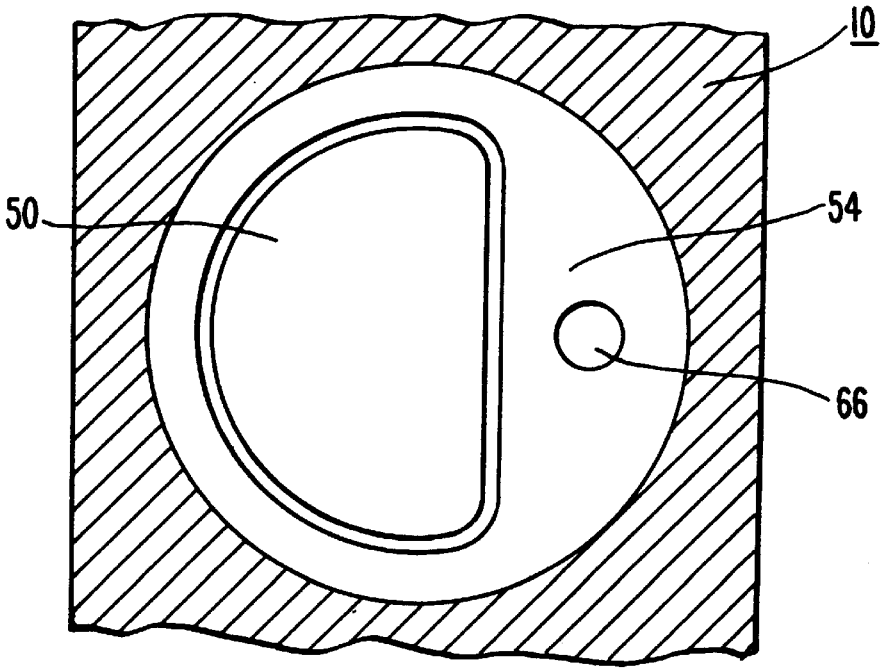
FIG. 4 is a sectional view of the compliant chamber taken along line 4—4 of FIG. 3.

Referring again to FIGS. 1 and 2, the check valves 32 are located in the print head at the end of supply channels 48. In accordance with another important aspect of this invention, the supply channels 48 are terminated in a compliant chamber 49 shown in FIGS. 1 and 2 and best shown in FIGS. 3 and 4. The compliant chamber is provided to attenuate brief disturbances which might otherwise deprime the print head. To this end, the compliant chamber comprises a flexible membrane 50 which is capable of movement in the direction shown by the arrows 52 in an amount sufficient to absorb ink pressure disturbances in the supply line through the print head so as to prevent depriming of the head. The membrane 50 is held in place between a stainless steel member 54 and a filter assembly 56. The stainless steel member 54 is in turn held in place between the membrane 50 and another gasket 58. In order to provide total freedom of movement of the flexible membrane 50, a vent hole 60 is provided in the print head juxtaposed to the membrane 50 so as to allow air to escape which is displaced by the membrane 50.

The filter assembly 56 includes a filter 62. As will be appreciated with reference to FIGS. 1–4, ink is free to flow into the compliant chamber 49 from an inlet 66 on the membrane side of the filter 62.

In order for the compliant chamber to best serve its purpose of preventing depriming of the ink jet, it is preferable that the membrane displacement be non-linear with respect to changes in pressure. For this purpose, the membrane 50 is shown as concave with respect to the interior of the chamber 49 such that resistance to deformation increases concavity of the diaphragm. In other words, deformation of the diaphragm is non-linear with respect to changes in pressure within the compliant chamber.

As also shown in FIG. 1, the inlet 66 of the print head is supplied with ink through a flexible tube 70 leading to a reservoir 72. The reservoir 72 as shown is including another filter 74 to assure that no agglomerations in the ink greater than the filler rating pass into the print head 10. Also note that the level of ink 76 in the reservoir 72 is maintained below the height of the ink jet chamber 14 so as to assure that no ink pressure at the chamber 16 thus avoiding weeping of ink from the orifices 15 in the orifice plate 14.

In order to better appreciate the manner in which the compliant chamber can prevent pressure disturbances from depriming ink jets, reference will now be made to FIG. 8 wherein an electrical circuit is shown which is equivalent to the fluidic circuit of the ink jet apparatus shown in FIG. 1. In particular, the apparatus shown in FIG. 1 is depicted in equivalent electrical circuit form using capacitance, resistance and inductance and a pressure disturbance equivalent to a voltage pulse being simulated by a pulse generator. More specifically, the equivalent circuit shown in FIG. 1 comprises a capacitance 80 and a resistance 82 corresponding to the capacitance and resistance of the orifice 15 in the orifice plate 14 respectively. A resistance 84 corresponds to the resistance of the restrictor 24. A capacitance 86 and a resistance 88 correspond to the fluidic capacitance and resistance of the manifold 30 including the feed lines 46. A capacitance 90 corresponds to the fluidic capacitance of the compliant chamber. A resistance 92 and a resistance 94 correspond to the fluidic resistance of the feed line 70 while an inductance 96 and an inductance 98 correspond to the fluidic inductance of that feed line 72. A capacitance 102 corresponds to the fluidic capacitance of the reservoir 72 and a voltage source 104 corresponds to the fluidic voltage or pressure generated by the reservoir 72. Any pressure disturbance in the feed line which is of a nature which could otherwise deprime the ink jet is depicted by a signal generator 106 located between the resistances 92 and 94 and the inductances 96 and 98 of the feed line.

Figure 8:
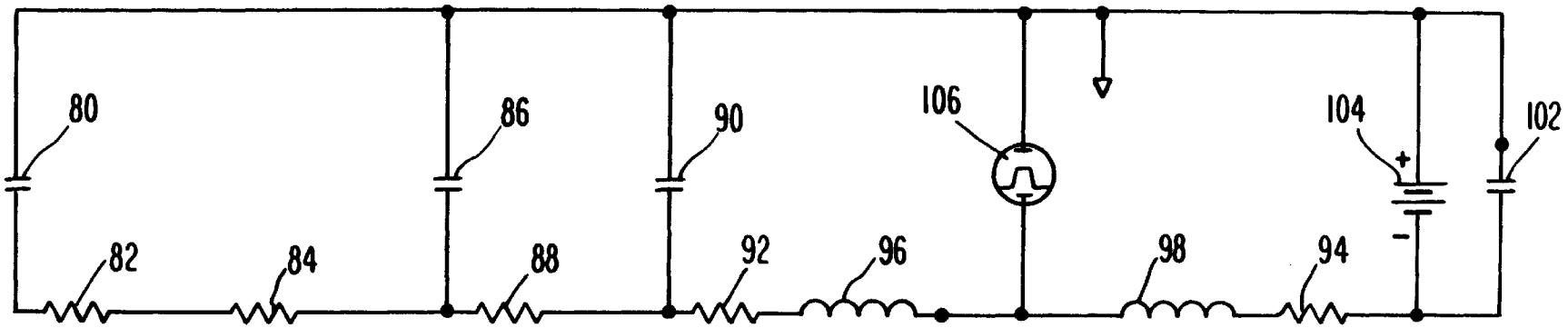
FIG. 8 is an equivalent electrical circuit for the fluidic system shown in FIGS. 1–7.
Figure 9:
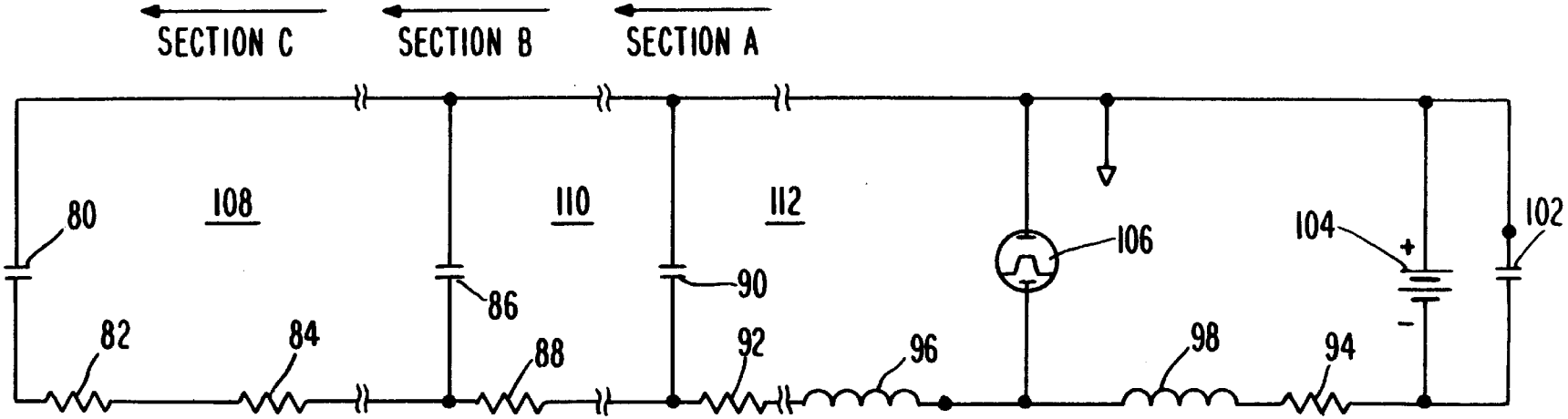
FIG. 9 corresponds to FIG. 8 with the equivalent electrical circuit broken into sections A through C.

The equivalent circuit of FIG. 8 may be broken down for purposes of analysis into a series of low pass filters depicted in FIG. 9. More specifically, a first low pass filter is provided by sub-circuit 108 comprising the fluidic capacitance 80 and the fluidic resistances 82 and 84. A second sub-circuit 110 comprises fluidic capacitance 86 and fluidic resistance 88. A third sub-circuit 112 comprises fluidic capacitance 90 of the compliant chamber and fluidic resistance 92 which is part of the feed line 70 resistance.

Figure 10:
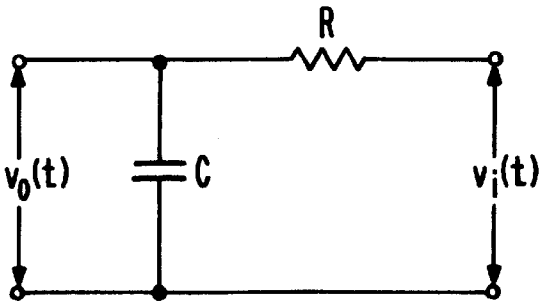
FIG. 10 is a classical first order low pass filter schematic.

As may be seen be reference to FIG. 10, each of the sub-circuits 108, 110 and 112 effectively form a classic first order low pass filter where $v_i(t)$ is an input voltage corresponding to the disturbance in the feed line and the $v_o(t)$ is the output voltage. By proper selection of the resistance R and the capacitance C of the low pass filter, the output voltage $v_o(t)$ corresponding to the output effect of the pressure disturbance represented by the $v_i(t)$ may be severely attenuated if the duration of the disturbance is less than the time constant Y corresponding to the product RC. In other words, disturbances which are sufficiently brief in time will be severely attenuated by the low pass filter represented by the sub-circuit 112 corresponding to the low pass filter represented by the RC combination of the compliant chamber capacitance 90 and the line resistance 92. More specifically, disturbances having a duration shorter than 10% of Y equal to the product of RC will be sufficiently attenuated so as not to have any material affect on the operation of the print head: i.e., will not deprime the print head or cause weeping through the orifices. In this regard, the flexible membrane is chosen so as to produce a time constant Y of at least 0.1 second and preferably more than 0.5 seconds such that disturbances less than 1/10 or 10% of the time constant Y will be substantially attenuated by the low pass filter formed by the compliant chamber in conjunction with the feed line resistance. More specifically, for a time constant of 0.1 seconds, the disturbance of less than 0.01 seconds or less than 1/10 or 10% of 0.1 seconds will have no effect on depriming or weeping. Similarly, for a time constant of at least 0.5 seconds, a disturbance of 0.05 seconds in duration will have little or no effect on depriming or weeping. It should be understood that in order for the compliant chamber to function as part of a low pass filter to serve the foregoing purpose, it is important that the compliant chamber be large enough to handle the volumetric disturbance without an undue increase in pressure.

As indicated previously, the check valves 32 will only prevent depriming in gross overpressure situations where they are useful in preventing back flow of ink. On the other hand, very small pressure changes which would otherwise produce depriming will not have that effect where the compliant chamber is utilized to provide the low pass filter characteristic. However, where there are very large pressure changes, the check valves do tend to pressurize the manifold section and prevent an unobjectionable massive deprime at the expense of some slightly objectionable orifice weeping.

It will be appreciated that the compliant chamber may take on different shapes and sizes. In particular, the flexible membrane may take on a different shape although it is preferred that the membrane provide a non-linear change in deformation with respect to changes in pressure.

Figure 11:
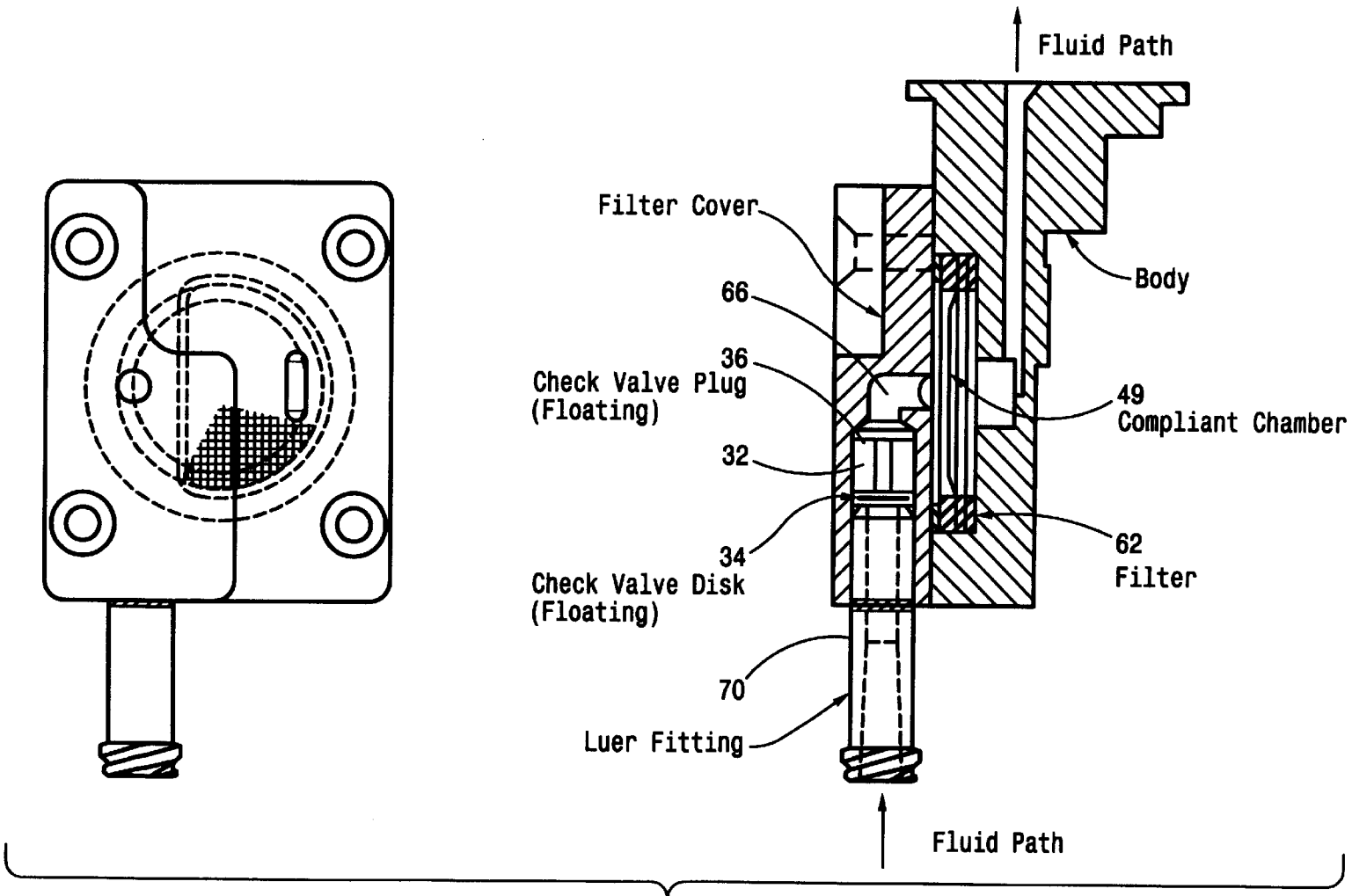
FIG. 11 depicts an alternative embodiment of an impulse ink jet head in accordance with the present invention. The primary difference between the embodiments depicted in FIGS. 11 and 1, respectively, is in the location of the check valve 32.

Referring now to FIG. 11, in an alternative preferred embodiment, the check valve 32 is allowed to float between the ink tube (feed line) 70 and the compliant chamber 49, in the "elbow" region of the filter assembly 66. It is important for proper operation of the invention that the wall surrounding the check valve have a rough surface to create a sufficient amount of friction with the ink, to cause the ink to flow against the movable disk of the check valve rather than around the disk. This embodiment was made in the process of developing a bar code print head. It has been found that this embodiment improves upon the print head's ability to stay primed. A pressure wave, e.g., one caused by sudden movement of the reservoir 72 or tube 70 (including shock, vibration, pumping, elevation, squeezing or heating of the feed tube or ink supply), will travel past the check valve 32 and slightly pressurize the compliant chamber 49. Subsequently, a negative part of the pressure wave will travel backward, from the face of the print head toward the compliant chamber, and seat the disk 34 of the check valve 32. In this manner, the pressure in the compliant chamber will remain large enough to prevent negative pressure from being developed at the orifices. This sequence can result in a small amount of ink being wept out of the face of the print head (during the positive cycle of the pressure wave), but it prevents air from being pulled into the print head. An important characteristic of this alternative embodiment of the invention relates to the way in which the check valve in combination with the compliant chamber prevent air from being sucked into, and thus depriming, the print head.

The compliant chamber is preferably designed to hold a negative pressure of between −0.1 and −10 in-$H_2O$, which is the range of pressures that are likely to be created by orifice jetting and the static height of said ink supply (i.e., the ink supply will typically be stationed slightly below the print head). In addition, to avoid jetting anomalies, the check valve is preferably designed to have a cracking pressure of between 0.1 and 3 in-$H_2O$. This prevents excessive buildup of negative pressure at the orifice during jetting.

Although preferred embodiments of the invention have been described in detail and various modifications suggested, other such modifications will occur to those of ordinary skill in the art which will fall within the true spirit and scope of the invention as set forth in the appended claims. For example, fluids other than ink may be utilized where the fluidic jets are used, for example, as meters. In addition, alternative ink jet configurations may be utilized where different types of transducers are used including the ink itself as in a bubble jet.

We claim:

1. A drop on demand impulse fluid jet apparatus, comprising:

a drop on demand impulse generating transducer;

a fluidic jet chamber operatively coupled to said transducer and having at least one orifice for ejection of droplets of fluid in response to energization of the transducer;

a fluid supply in fluid communication with said fluidic jet chamber by a fluid path, wherein during operation of the apparatus negative pressure is maintained within the apparatus, such that fluid flows within the apparatus by capillary action from said fluid supply to the orifice;

a compliant chamber located in said fluid path between said fluidic jet chamber and said fluid supply, said compliant chamber having a flexible membrane that deforms in response to pressure changes in said compliant chamber; and a check valve in said fluid path between said fluid supply and said compliant chamber, said check valve having an upstream side facing said fluid supply and a downstream side facing said compliant chamber, wherein said check valve is openable to permit a forward fluid flow in the apparatus from said fluid supply to said orifice when fluid pressure on the upstream side of said check valve is greater than fluid pressure on the downstream side of said check valve, and wherein said check valve is closable to prevent a reverse fluid flow in the apparatus from said orifice to said fluid supply when fluid pressure on the upstream side of said check valve is less than or equal to the fluid pressure on the downstream side of said check valve, such that a disturbance in the apparatus, which causes a pressure wave in the apparatus, does not result in depriming of fluid at the orifice.

2. A drop on demand impulse fluid jet apparatus in accordance with claim 1, wherein said check valve is a floating valve plate movable to an open position away from a valve seat and to a closed position against said valve seat by a reverse.

3. A drop on demand impulse fluid jet apparatus in accordance with claim 1 wherein said check valve is openable at a pressure of between 0.1 and 3 inches $H_2O$.

4. A drop on demand impulse fluid jet apparatus in accordance with claim 1 wherein the disturbance is on the upstream side of said check valve.

5. A drop on demand impulse fluid jet apparatus in accordance with claim 1 wherein the disturbance is on the downstream side of said check valve.

6. A drop on demand impulse fluid jet apparatus in accordance with claim 1 wherein the disturbance causes a positive pressure wave.

7. A drop on demand impulse fluid jet apparatus in accordance with claim 1 wherein the disturbance causes a negative pressure wave.

8. An impulse ink jet apparatus, comprising:

an ink supply;

an ink chamber having an orifice and an actuator for generating pressure pulses within said ink chamber thereby ejecting ink from the orifice, said ink chamber having a negative pressure threshold, such that pressure in said ink chamber below the negative pressure threshold results in depriming of ink from the orifice;

a compliant chamber having a flexible membrane for increasing or decreasing the volume of said compliant chamber in response to pressure changes within said compliant chamber, said compliant chamber being disposed between said ink supply and said ink chamber, wherein said ink supply, said compliant chamber and said ink chamber are fluidically connected, and wherein a negative pressure in said ink chamber causes ink to flow from said ink supply to said compliant chamber, and from said compliant chamber to said ink chamber; and a check valve disposed in the fluidic connection between said ink supply and said compliant chamber, wherein said check valve is open when the pressure on the ink supply side of said check valve is greater than or equal to the pressure in said compliant chamber, and wherein said check valve is closed when the pressure on the ink supply side of said check valve is less than the pressure in said compliant chamber, such that the pressure in said ink chamber is maintained at or above the negative pressure threshold.

9. A method of operating an impulse ink jet apparatus to prevent depriming of the apparatus by a pressure disturbance within the apparatus, comprising the steps of:

fluidically connecting an ink supply to an ink chamber, said ink chamber having an orifice and an actuator for generating pressure pulses within said ink chamber thereby ejecting ink from the orifice, said ink chamber having a negative pressure threshold, such that pressure in said ink chamber below the negative pressure threshold results in depriming of ink from the orifice; and disposing a compliant chamber and a check valve in the fluidic connection, said compliant chamber having flexible membrane, and said check valve being disposed between said ink supply and said compliant chamber;

wherein a positive pressure disturbance causes the flexible membrane to expand and the check valve to remain open until the pressure in said compliant chamber is greater or equal to the pressure on the ink supply side of the check valve, and wherein a negative pressure disturbance causes the check valve to close until the pressure in said compliant chamber is less than the pressure on the ink supply side of the check valve, such that the pressure in said ink chamber is maintained at or above the negative pressure threshold during any pressure disturbance.

10. A method according to claim 9, further comprising the step of causing ink to flow from said ink supply to said ink chamber by capillary action.

* * * * *

UNITED STATES PATENT AND TRADEMARK OFFICE

CERTIFICATE OF CORRECTION

PATENT NO. : 6,209,997 B1
DATED : April 3, 2001
INVENTOR(S) : Ha Van Duong, et al.

It is certified that error appears in the above-identified patent and that said Letters Patent is hereby corrected as shown below:

Title page

Item [75], inventors, after "Danbury" insert -- ; Ronald L. Green, Brookfield --

Signed and Sealed this

Sixth Day of November, 2001

*Attest:*

Nicholas P. Godici

NICHOLAS P. GODICI

*Attesting Officer*

*Acting Director of the United States Patent and Trademark Office*